United States Patent [19]

Venditti

[11] 4,080,684

[45] Mar. 28, 1978

[54] COATING APPLICATOR

[76] Inventor: Gaêtan Venditti, 10 rue Frere Benoit, Oullins (Rhone), France

[21] Appl. No.: 692,112

[22] Filed: Jun. 2, 1976

[30] Foreign Application Priority Data

Jun. 3, 1975 France ..... 75 17849

[51] Int. Cl.[2] ..... B05C 11/00

[52] U.S. Cl. ..... 15/104 S; 15/235.8; 401/48

[58] Field of Search ..... 15/104 S, 235.4, 235.6, 15/235.8; 401/48, 266

[56] References Cited

U.S. PATENT DOCUMENTS

| | | | |
|---|---|---|---|
| 397,129 | 2/1889 | Hill | 15/235.5 |
| 2,301,498 | 11/1942 | Ames | 15/235.8 |
| 2,436,351 | 2/1948 | Bradley, Jr. | 15/104 S |

FOREIGN PATENT DOCUMENTS

| | | | |
|---|---|---|---|
| 502,431 | 11/1954 | Italy | 401/266 |

*Primary Examiner*—Peter Feldman
*Attorney, Agent, or Firm*—Karl F. Ross

[57] ABSTRACT

A tool for applying plaster or other coating materials to a wall comprises a blade with a flat underside and a handle on its upper face, the ends of the blade being adjustably secured to a pair of cheek plates whose lower edges form skids for guiding the trailing edge of the blade at a selected distance from the wall surface to be coated. The front and rear edges of each cheek plate, engaged by slides attached to the blade, are inclined with reference to its bottom edge to maintain the blade at a small angle to the engaged wall surface. The slides of each cheek plate are interconnected by a yoke carrying a micrometric screw for varying the thickness of the coating by relatively displacing the yoke and the cheek plates.

8 Claims, 2 Drawing Figures

COATING APPLICATOR

FIELD OF THE INVENTION

The present invention relates to a tool for applying plaster or other coating materials to the surfaces of walls, ceilings etc.

BACKGROUND OF THE INVENTION

Conventional coating applicators of this type include relatively large tools called mortarboards or hawks and smaller tools called trowels. In the hands of a skilled workman such tools are satisfactory for making uniform coatings of limited thickness, e.g. in the form of a plaster layer on an internal or external building wall which is to be covered by an outer finishing layer.

Some coating materials available today for protective and/or decorative purposes can be deposited on a surface as a relatively thick layer which can subsequently be adorned by tracings made therein, before complete hardening, with the aid of simple utensils such as a blade or an indented roller. The application of such heavy coatings to a substrate with the aid of conventional tools requires, however, great care if the thickness of the layer is to be reasonably uniform.

OBJECT OF THE INVENTION

The general object of my present invention is to provide an improved tool of the character described which allows the maintenance of uniform thickness of a coating applied to a wall surface or other substrate.

A more particular object is to provide means on such a tool for enabling a fine adjustment of the selected coating thickness.

SUMMARY OF THE INVENTION

I realize these objects, in accordance with my present invention, by the provision of a blade with a flat underside bounded by a leading edge and a trailing edge, the blade being grippable with the aid of handle means on its upper face. A pair of supports, such as two cheek plates, are adjustably secured to opposite ends of the blade (i.e. to the minor sides of its generally rectangular outline) to form skids which are engageable with the surface to be coated and which guide the blade with its trailing edge at a selected distance from that surface.

Advantageously, according to another feature of my invention, the connection between the cheek plates and the blade is so arranged that the skid-forming bottom edges of these plates diverge from the underside of the blade with increasing distance from its trailing edge. This results in the formation of a wedge-shaped clearance between the blade and the surface to be coated whereby the coating material is extruded under a certain pressure through the gap between that surface and the trailing edge of the blade.

Pursuant to another feature of my invention, the blade is connected with each cheek plate through a pair of slides engaging the front and rear edges of the plate, these slides being preferably interconnected by a rigid link such as a yoke curving away from the bottom edge of the plate. The link and the associated cheek plate are provided with adjustable couplings, including coacting formations, e.g. a micrometric screw threaded into the vertex of the yoke, for varing the distance of the blade from the bottom edges of the cheek plates and therefore from the underlying substrate. The distance between the trailing edge and the substrate surface, determining the thickness of the coating, may be read on scales advantageously provided for this purpose on the two cheek plates.

BRIEF DESCRIPTION OF THE DRAWING

The above and other features of my invention will now be described in detail with reference to the accompanying drawing in which.

SPECIFIC DESCRIPTION

Figure 1:
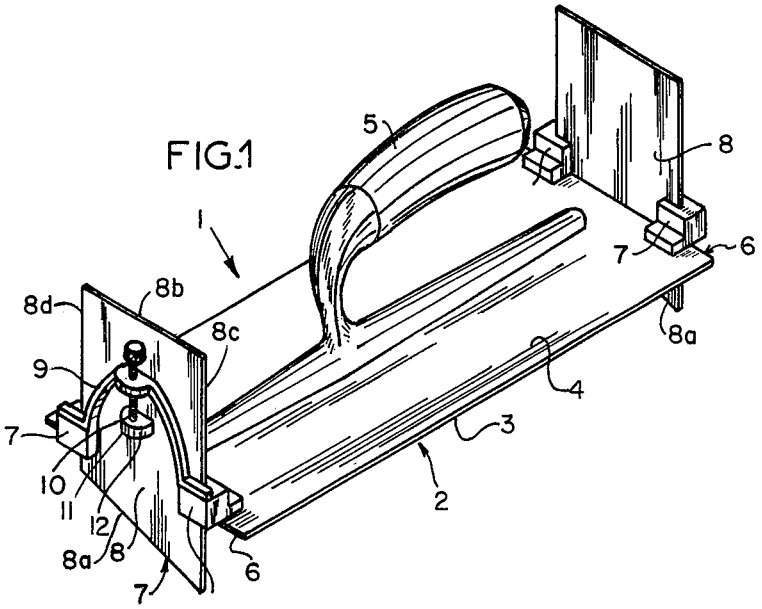
FIG. 1 is an isometric view of a coating applicator according to my invention.
Figure 2:
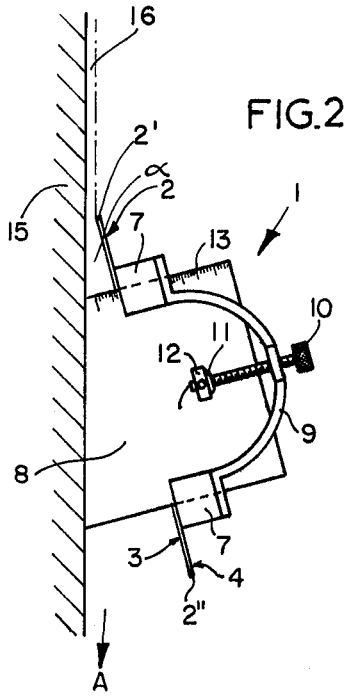
FIG. 2 is an end view of the applicator shown in FIG. 1.

In FIG. 1 I have shown a tool 1, representing my improved coating applicator, which comprises a blade 2 of rectangular outline with a flat smooth underside 3 and with an upper face carrying a handgrip 5. The major sides of the rectangle form a trailing edge 2' and a leading edge 2'' (see FIG. 2) when the tool 1 is displaced over a wall surface 15 to be coated, as indicated by an arrow A.

The ends of the blade 2 are supported on a pair of parallel cheek plates 8 perpendicular thereto, these plates having trapezoidal outlines with bottom edges **8*a*, top edges 8*b*, front edges 8*c* and rear edges 8*d*. Bottom edges 8*a* constitute a pair of skids which engage the wall surface 15 to hold the trailing edge 2' of the blade 2 at a selected distance from that surface. The front and rear edges 8*c* and 8*d* of each cheek plate 8 are engaged by respective slides 7 secured to lateral blade edges 6 which define the minor sides of the rectangular outline of blade 2. Thanks to an inclination of these plate edges 8*c* and 8*d* relative to bottom edge 8*a*, the blade 2 diverges at a small angle $\alpha$ (e.g. between about 5° and 30° ) from the surface 15 so that its trailing edge 2' is closer to the surface than is its leading edge 2''. As the tool 1 advances in the direction of arrow A, plaster or other coating material is wedged between surfaces 3 and 15 to form a coating 16 of uniform thickness in the wake of the tool. The orientation of top edge 8*b* is, of course, not critical. As shown, blade edges 2' and 2'' project well beyond the front and rear edges 8*c* and 8*d*, respectively, of cheek plates 8**.

The two slides 7 engaging the front and rear edges of each plate 8 are interconnected by a yoke-shaped link 9 on the outer side of the plate remote from blade 2. The vertex of the yoke 9 has a threaded bore traversed by a micrometric screw 10 whose lower end bears upon a lug 12 rigid with plate 8, being preferably coupled with that lug through a shoulder 11 and a rivet head 17 so as to be axially fixed with reference to the lug while being freely rotatable therein. Rotation of screw 10 thus raises or lowers the front and rear slides 7 and with them the blade 2 along the rising edges **8*c* and 8*d* of the cheek plate 8; this displacement may be read on a scale 13 of each plate which not only indicates the thickness of the layer 16** but also allows identical distance adjustments to be made on both cheek plates.

I claim:

1. A tool for applying a flowable mass to a surface to be coated, comprising:

a pair of parallel cheek plates each having a front edge, a rear edge and a bottom edge, the front and rear edges of said cheek plates being parallel to one another and inclined to their bottom edges at an angle of less than 90°;

a pair of supports each including a front slide and a rear slide engaging said front and rear edges of a respective cheek plate;

a generally rectangular blade between said cheek plates bounded by a leading edge and a trailing edge transverse to said cheek plates and a pair of lateral edges gripped by said slides, said leading edge being elevated more than said trailing edge above the level of said bottom edges;

adjustable couplings between said cheek plates and said supports for varying the elevation of said leading and trailing edges above said level; and handle means on an upper face of said blade.

2. A tool as defined in claim 1 wherein said leading edge lies forwardly of said front edges, said trailing edge lying rearwardly of said rear edges.

3. A tool as defined in claim 1 wherein said each of said supports further includes a yoke rigidly interconnecting said front and rear slides thereof.

4. A tool as defined in claim 3 wherein said adjustable couplings comprise coacting formations on said yoke and on the respective cheek plate.

5. A tool as defined in claim 4 wherein said coacting formations include a pair of micrometric screws.

6. A tool as defined in claim 5 wherein said yokes curve away from said bottom edges and are provided at their vertices with threaded bores receiving said screws, said formations further including abutments on said cheek plates coacting with said screws.

7. A tool as defined in claim 6 wherein said yokes and said abutments are disposed on outer sides of said cheek plates remote from said blade.

8. A tool as defined in claim 1 wherein said cheek plates are provided along said rear edges with scales coacting with said rear slides for measuring the distance of said trailing edge from the surface to be coated.

* * * * *